US005599115A

United States Patent [19]

Radcliffe et al.

[11] Patent Number: 5,599,115

[45] Date of Patent: Feb. 4, 1997

[54] SUPPLY CARTRIDGE AND METHOD FOR RIBBON DELIVERY SYSTEM

[75] Inventors: William W. Radcliffe, Pitman, N.J.; Kedar M. Morarka, Aurora, Colo.

[73] Assignee: NER data products inc., Glassboro, N.J.

[21] Appl. No.: 431,339

[22] Filed: Apr. 28, 1995

[51] Int. Cl.[6] ..... B41J 35/28

[52] U.S. Cl. ..... 400/207; 400/208

[58] Field of Search ..... 400/207, 208, 400/208.1, 242, 246

[56] References Cited

U.S. PATENT DOCUMENTS

| | | | |
|---|---|---|---|
| 2,930,465 | 3/1960 | Lotsch | 197/6.7 |
| 3,127,989 | 4/1964 | Travaglio | 206/52 |
| 3,294,228 | 12/1966 | Urso | 206/52 |
| 3,520,495 | 10/1967 | Sotani | 400/208 |
| 3,627,118 | 12/1971 | Daggs | 206/52 R |
| 3,813,056 | 5/1974 | Hagen et al. | 242/197 |
| 4,557,617 | 12/1985 | Richardson | 400/208 |
| 4,564,303 | 1/1986 | Rosenberg et al. | 400/208 |
| 4,823,953 | 4/1989 | Anderson et al. | 206/408 |
| 4,955,737 | 9/1990 | Haftmann et al. | 400/208 |
| 4,998,833 | 3/1991 | Chiman | 400/208 |
| 5,098,208 | 3/1992 | Martinez | 400/208 |
| 5,145,066 | 10/1992 | Clark et al. | 206/409 |
| 5,269,612 | 12/1993 | Shimoha et al. | 400/207 |

FOREIGN PATENT DOCUMENTS 60-18373 1/1985 Japan .

*Primary Examiner*—Edgar S. Burr
*Assistant Examiner*—Daniel J. Colilla
*Attorney, Agent, or Firm*—Thomas J. Loran

[57] ABSTRACT

An apparatus and method for storing and supplying a ribbon containing ink in a system used for printing information. A cartridge protects the tape during shipping and storage and enables easy replacement of a ribbon into a printer. The cartridge provides a volume for accumulation of used tape wound on a take-up reel. The cartridge contains elastomer strips to protect, guide, and apply tension to all the tape during operation and storage.

9 Claims, 3 Drawing Sheets

SUPPLY CARTRIDGE AND METHOD FOR RIBBON DELIVERY SYSTEM

BACKGROUND OF THE INVENTION

1. Field of the Invention

The present invention is generally directed to an apparatus and method for storing and supplying a ribbon containing ink in a system used for printing information.

2. Description of the Prior Art

Documents such as checks from a person's checkbook are manufactured and processed by banking institutions using Magnetic Image Character Recognition (MICR) ink. The present method of storing and delivering ribbon containing MICR ink that is coated on substrate surfaces and then wound on a take-up spool for disposal has many problems. Before placing a ribbon wound on a core in the printing machine, an operator at the printing site inserts a mounting spool with proper alignment into the core using care not to move or telescope the rolled ribbon. This is accomplished using manual pressure. Providing pressure on the mounting spool while holding the ribbon roll may distort the edges of the tape resulting in uneven accumulation on the take-up spool that affects the operation of the printing mechanism and can cause temporary equipment failure.

Mishandling the ribbon leader strip during insertion of the spool may also result in destroying part of the ink surface that causes misprinting and affects quality of the product. The present ribbon supply spool provides only partial radial support on one side to contain the ribbon roll. Therefore exposure to temperature or humidity extremes can distorted the rolled ribbon that would not align correctly during cooling.

To prevent various designs of stored ribbon spools from unraveling during handling or use, tension devices such as springs are mounted to contact one position on the spool, ribbon, or mounting shaft. Because of single point contact on a ribbon edge or shaft, the tension of many of these devices is not constant as the ribbon is depleted. Many tension mechanisms are complicated and do not aid in maintaining the supply spool ribbon shape during operation or storage.

Prior art, U.S. Pat. No. 4,564,303, uses a ribbon cartridge employing two separate ribbon supplies and contains the take-up reel in a single cartridge. The design combines the supply and take-up operations on different elevations to contain both the entire supply and take-up amounts on separate reels. U.S. Pat. No. 4,823,953, a dispensing tape cartridge, teaches a tape guide that provides high pressure so the tape can be reversed in direction to unroll, re-roll or cut to remove printed indicia. This is similar to U.S. Pat. Nos. 2,930,465 and 3,127,989 where high pressures on the tapes provide cutting or removing imprinted tape.

U.S. Pat. Nos. 3,294,228; 3,627,118; 4,557,617; Japanese Patent 60-18373; and IBM Technical Disclosure Bulletin Vol. 25, No. 12, page 6676 and 6677 indicate various methods of providing tension on ribbons in cartridges. U.S. Pat. No. 3,813,056; 4,557,617; and 5,269,612 provide supply and take-up on the same reel.

The present invention solves the above stated problems for a MICR ribbon system and can also be used in other printing devices and methods employing ribbons and tapes.

SUMMARY OF THE INVENTION

The present invention provides an apparatus and method for storing and supplying ribbon used to print information on various media surfaces while providing a storage volume for ribbon take-up after printing. The ribbon, wound on a spool, is contained in a cartridge having sections that have been joined to contain and protect the ribbon and enable an operator to easily replace printing ribbon. The mounting shaft component, formerly used for assembly into the machine, has been eliminated. The cartridge inner surfaces contain elastomers that radially contact all the edges of the ribbon, maintaining the ribbon in fixed position in the cartridge during storage and shipping, and providing tension on all the remaining ribbon during operation. The cartridge contains at least two lateral openings, one to exit the ribbon from the cartridge, and the other to allow ribbon from the take-up spool to occupy part of the cartridge volume previously used by the supply ribbon. There is also a provision to insert into the ribbon core a means for manually rotating the ribbon after assembly in the cartridge.

Accordingly, an object of the invention is to provide a cartridge and method for a ribbon storage and delivery for use in a printing device.

Another object of the invention is to provide protection of rolls of ribbon used to imprint characters on various information media during storage, shipping, insertion, and use in a printing device.

Another object of the invention is to provide ease of insertion of supply ribbon into a printing device.

Another object of the invention is to eliminate the need and assembly of any spool into the ribbon supply core used in a printing device.

Another object of the invention is to provide a volume within the cartridge for accumulation of used ribbon wound on a take-up spool.

Another object of the invention is to provide a small tension on the supply ribbon by forcing elastomers against all the edges of the rolled ribbon to maintain tension until the ribbon is depleted. These same elastomers provide a means to retain the shape and position of the ribbon on the supply spool during shipping, assembly, and use. The elastomers may also guide the take-up ribbon when this ribbon is accumulated in the volume of the supply ribbon cartridge.

Another object of the invention is to provide a means for manually unrolling the ribbon from the cartridge or re-rolling the ribbon into the cartridge.

DETAILED DESCRIPTION OF THE PREFERRED EMBODIMENT

Figure 1:
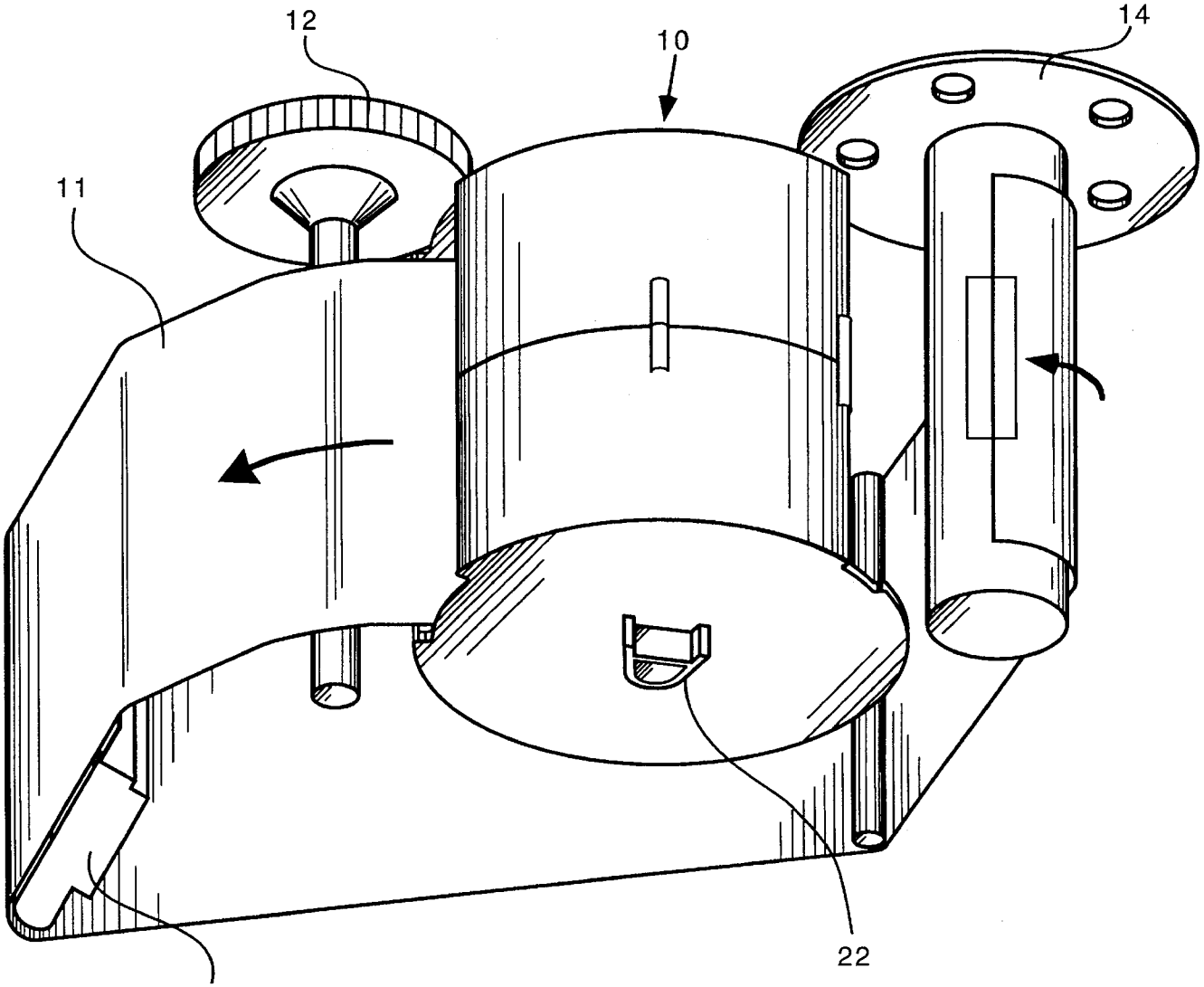
FIG. 1 is a schematic and side elevation view of a printing ribbon printing assembly including the supply cartridge and take-up spool in MICR printing section equipment.

FIG. 1 shows a schematic and side elevation view of a MICR printing assembly in the MICR printing section equipment. The ribbon delivery system shown in this figure includes the ribbon supply cartridge 10 that includes the rolled ribbon 11 that passes over the metering roll 12 around the printing section 13, under the supply cartridge and is rolled on take-up spool 14. A spool of similar design to the take-up spool was formerly inserted into the supply ribbon core. This supply spool is no longer needed in the present invention.

The design of supply cartridge 10 permits the accumulated ribbon on the take-up spool to use a volume in the supply cartridge that was formerly occupied by supply ribbon.

Figure 2:
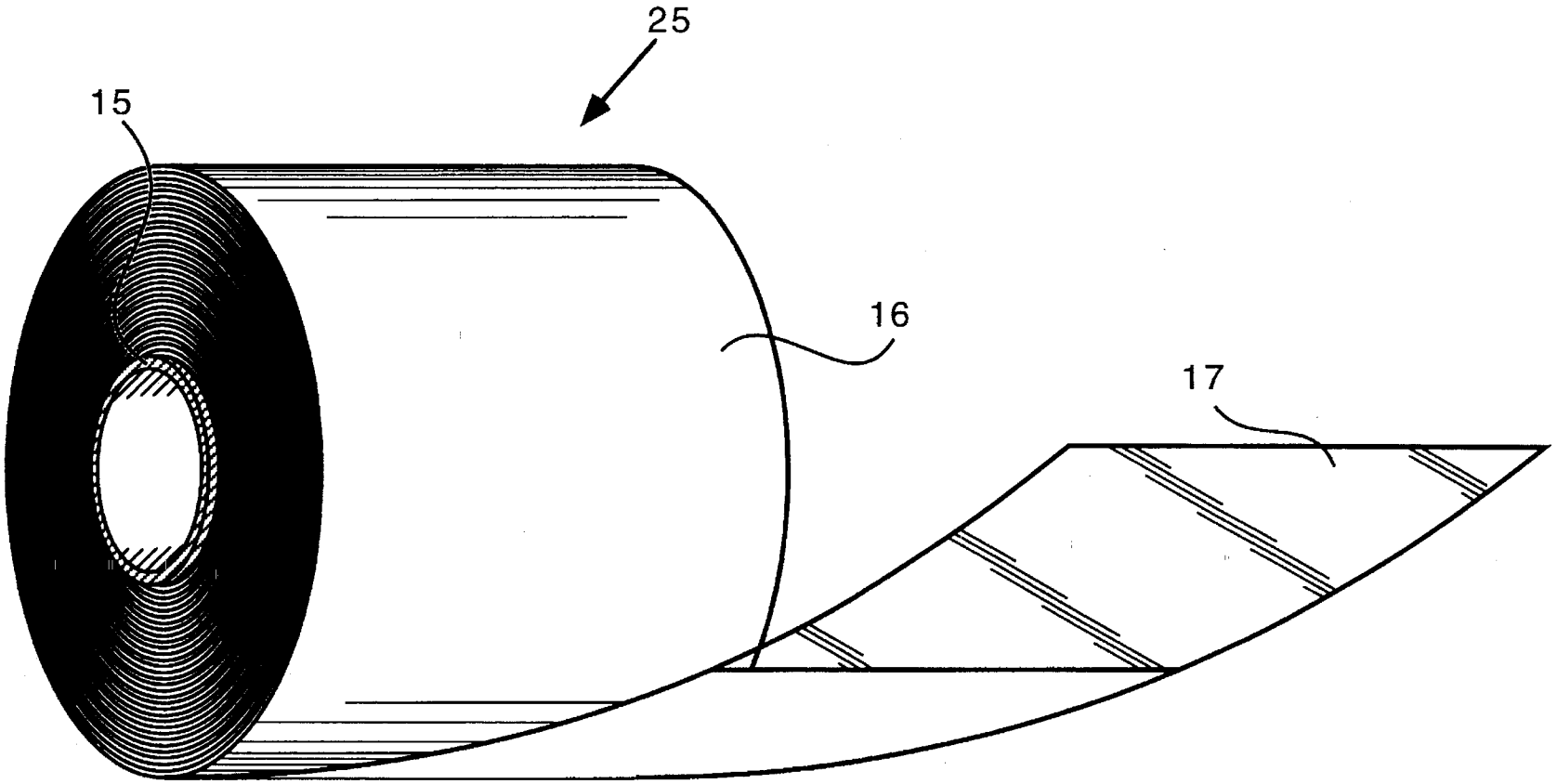
FIG. 2 is a perspective side view of the ribbon rolled on a core cylinder prior to insertion into the supply cartridge.

FIG. 2 shows a perspective side view of the ribbon rolled on a core cylinder, assembly 25, prior to insertion into the supply cartridge 10. The core cylinder 15 is constructed from paper, wood, thermoset plastic or thermoplastic metal or other rigid materials. Paper and thermoplastic materials are preferred. An outer core diameter of about one inch is preferred but other diameters are also suitable. The core inner diameter depends upon the material of construction but is sufficiently thick so the core shape does not distort during use. The core center diameter need not be complete through the core but may be recessed depths on each end to fit over matching supports located in the sides of the cartridge.

The ribbon 16 is any flexible material constructed from plastic, metal, or cloth containing ink coating or information that may be transferred to another surface by force, heat, or electronic means. The terms tape and ribbon to describe the ink transport material are considered to be synonymous in this invention. Polyester plastic such as MYLAR (™ E.I. duPont) Polyester film ribbon is preferred flexible material but other thermoset or thermoplastic materials may be used for ribbon. Various ribbon thicknesses that have sufficient strength to resist tear or break during operation are acceptable. The cartridge and system are best for ribbons having widths greater than one-fourth inch with the optimum width being two and one-fourth inches. Larger ribbon widths are also suitable. Although many ribbon lengths are possible for use in the present invention, a preferred ribbon length is nine hundred feet. The ribbon may have a clear plastic leader 17 to assist the equipment operator to "thread" or feed the ribbon through a path as shown in FIG. 1 or any other suitable path for printing characters on other surfaces.

Figure 3:
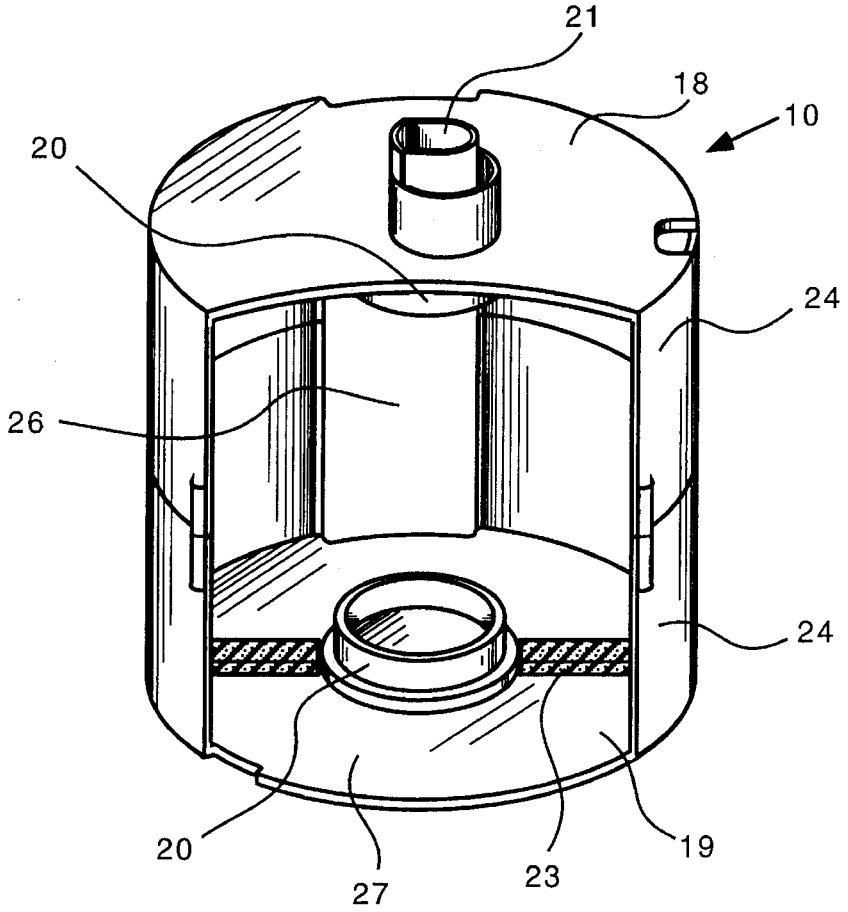
FIG. 3 is a schematic and perspective view of the ribbon supply cartridge according to this invention without the ribbon and core.

FIG. 3 is a schematic and perspective view of the ribbon supply cartridge 10 according to this invention assembled without the ribbon and core. The cartridge includes two side surface members 18 and 19, for supporting the core and protecting the edges of the ribbon roll 16. Centrally located inside of each side surface member is a round projection 20 that inserts into the core center, aligning and supporting the core, while permitting the ribbon and core to rotate. The side surface members are preferably shaped round having a diameter greater than the diameter of the roll of ribbon. Other side surface member shapes that are larger in size than the ribbon roll diameter are possible. The side surface members are preferably manufactured from rigid thermoplastic materials or thermosetting plastics having a thickness necessary to support the roll of ribbon. Other rigid materials such as paper or metals are also suitable. The rigid plastics may be selected from thermoplastics such as polystyrenes, polyethylenes, polycarbonates, polypropylenes, polyamides, polyesters, polyvinyls, etc. or mixtures of these materials.

Outside of each side surface member is a centrally located mounting projection having a design that engages a slot in the printer frame. One side projection has two parallel sides 21 designed to slide into a similar shape slot located in the MICR printer. These slots rigidly support the cartridge and prevent cartridge rotation. The other side projection has sloped edges 22 (FIG. 1) that also mate with the printer housing. Other designs for mounting are possible that will support the cartridge and prevent cartridge rotation. The outside mounting projections do not necessarily need to be centrally located to provide needed support.

Attached to the inner wall surface of each side surface member are preferably radial positioned elastomer strips 23 that contact all the stored ribbon edges. At least one strip is necessary although a plurality of strips may be used. The elastomer may be other shapes and positions provided contact is made on the entire ribbon edge on either one or both sides. Preferably, elastomer contact is on both sides of the ribbon edges. The strips provide correct alignment of the ribbon on the core during storage, shipping and use. The entire side contact of the ribbon by the elastomer strip provides a constant tension on all the ribbon during printing thereby allowing a smooth movement of ribbon on demand. The strips are preferably foamed elastomers, manufactured from materials such as polyurethane, natural or synthetic rubber, neoprenes, polyvinyl chloride, silicone and other synthetic or natural polymers. The strips may be placed so ribbon from the take-up spool may also be guided into a storage volume as described below.

A connecting frame means 24 between the sides 18 and 19 completes the cartridge structure. This frame shape should generally match the peripheral shape of the sides, but may be a skeleton frame or partially enclose the volume occupied by the ribbon roll. The frame may connect directly to each side for constructing the cartridge assembly. Also, part of the frame may be integral with one side and connect to the other side, or both sides have integral parts of the frame that will be joined together after insertion of the ribbon and spool assembly 25 as shown in FIG. 2. The coupling of the frame to the sides after insertion of the ribbon roll and core to complete the cartridge assembly may be accomplished by using male and female connections, adhesives, welding, or ultrasonics, or mechanical means such as straps, nuts and bolts, screws, or combinations of these methods.

The frame provides one aperture 26 for tape exit from the cartridge. This aperture has sufficient size to exit the ribbon from the cartridge without damage. Another aperture 27 in the frame is sufficiently large to partially store take-up spool ribbon within the cartridge volume during printing. In the present MICR apparatus, the storage of take-up ribbon is located approximately opposite the ribbon exit. The size and location of the openings may vary with printing machine design.

Figure 4:
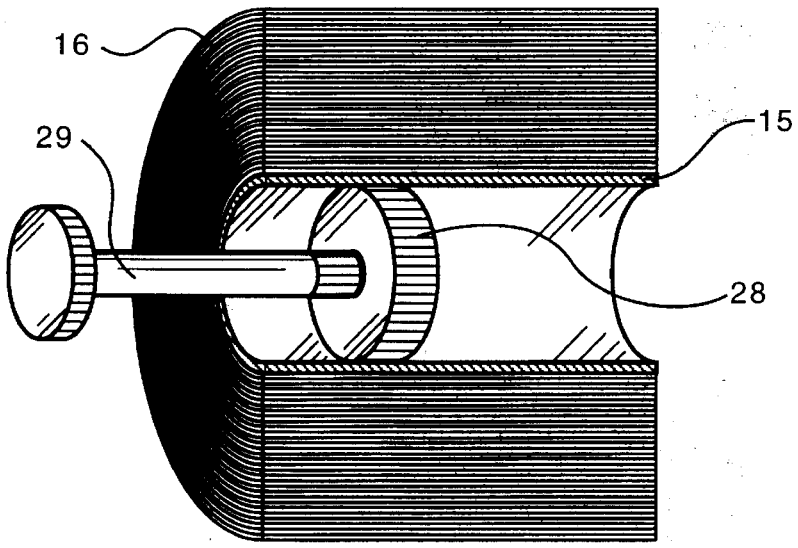
FIG. 4 is a partial sectional side view of the ribbon and core assembly.

FIG. 4 is a partial sectional side view of the ribbon and core assembly. The ribbon core may contain an inner diameter insert 28 that centrally connects a shaft 29 that extends outside the cartridge through an opening in the side member 18 aligned with the center of the core. The insert and shaft may be one piece. By manually rotating the extended shaft, the core and ribbon are rotated and the ribbon is either unwound or rewound when desired without manual contact of the ribbon.

From the above description of the invention, various changes and modifications to the apparatus will occur to those skilled in the art. All such modifications coming within the scope of the appended claims are intended to be included therein.

We claim:

1. An apparatus for storing and supplying a ribbon containing ink for use in printing section equipment having a take-up spool comprising: a cartridge, a core being rigidly mounted in the cartridge, (a) a single roll of single use ribbon wound on said core, (b) side surface members having a means for supporting and protecting said roll of ribbon wound on said core, (c) a frame means for connecting said side surface members to form said cartridge, (d) said frame means providing an aperture for exit of said ribbon, (e) said frame means providing a second aperture to a volume inside said cartridge that allows ribbon on said take-up spool to partially occupy said cartridge volume previously used by said roll of ribbon and, (f) a means for mounting said cartridge in said printing section equipment.

2. An apparatus as recited in claim 1 wherein said frame means substantially encloses said cartridge.

3. An apparatus as recited in claim 1 wherein said side surface members are round in shape.

4. An apparatus as recited in claim 1 further comprising a means for engaging and manually rotating said ribbon and said core.

5. A method for protecting and supplying a ribbon containing ink for use in printing section equipment having a take-up spool comprising the steps of: providing a cartridge having a core rigidly mounted therein (a) providing a single roll of single-use ribbon wound on said core, (b) providing side surface members having a means for supporting and protecting said roll of ribbon wound on said core, (c) providing a frame means for connecting said side surface members to form said cartridge, (d) providing an aperture in said frame means for exit of said ribbon, (e) providing a second aperture to a volume inside said cartridge that allows ribbon on said take-up spool to partially occupy said cartridge volume previously used by said roll of ribbon and, (f) providing a means for mounting said cartridge in said printing section equipment.

6. The method for protecting and supplying a ribbon containing ink to printing a section equipment as recited in claim 5 further comprising the step of substantially enclosing said frame means of said cartridge.

7. The method for protecting and supplying a ribbon containing ink to printing section equipment as recited in claim 5 wherein said side surface members are round in shape.

8. The method for protecting and supplying a ribbon containing ink to printing section equipment as recited in claim 5 further comprising the step of providing a means for engaging and manually rotating said ribbon and core.

9. A method for protecting and supplying a ribbon containing ink to printing section equipment as recited in claim 5 wherein said frame means and said side members are manufactured from a group consisting of polystyrenes, polyethylenes, polycarbonates, polypropylenes, polyamides, polyesters, and polyvinyls.

* * * * *